US005729261A

United States Patent [19]

Burke et al.

[11] Patent Number: 5,729,261

[45] Date of Patent: Mar. 17, 1998

[54] THERMAL INK JET PRINTHEAD WITH IMPROVED INK RESISTANCE

[75] Inventors: Cathie J. Burke, Rochester; Daniel E. Kuhman, Fairport; Daniel O. Roll, Pittsford; Alan D. Raisanen, Sodus, all of N.Y.

[73] Assignee: Xerox Corporation, Stamford, Conn.

[21] Appl. No.: 623,081

[22] Filed: Mar. 28, 1996

[51] Int. Cl.[6] ..... B41J 2/05

[52] U.S. Cl. ..... 347/64; 347/45

[58] Field of Search ..... 347/64, 65, 45

[56] References Cited

U.S. PATENT DOCUMENTS

| | | | |
|---|---|---|---|
| Re. 32,572 | 1/1988 | Hawkins et al. | 156/626 |
| 4,412,224 | 10/1983 | Sugitani | 347/65 |
| 4,532,530 | 7/1985 | Hawkins | 347/64 X |
| 4,596,994 | 6/1986 | Matsuda | 347/64 |
| 4,774,530 | 9/1988 | Hawkins | 347/63 |
| 4,829,324 | 5/1989 | Drake et al. | 347/63 |
| 4,851,371 | 7/1989 | Fisher et al. | 347/42 X |
| 5,008,689 | 4/1991 | Pan et al. | 347/63 |
| 5,010,355 | 4/1991 | Hawkins et al. | 347/64 |
| 5,073,785 | 12/1991 | Jansen | 347/45 |
| 5,119,116 | 6/1992 | Yu | 347/65 |
| 5,257,042 | 10/1993 | Buhler | 347/64 |
| 5,291,226 | 3/1994 | Schantz et al. | 347/63 |

*Primary Examiner*—Joseph W. Hartary

[57] ABSTRACT

An ink jet printhead has improved resistance to the corrosive effects of ink by coating the surface of a photo-imageable polymer with an ink resistant film. In one described embodiment, a thermal ink jet element is formed by bonding together a channel plate and a heater plate. Resistors and electrical connections are formed in the heater plate. A polyimide layer is formed so as to overlie the heater plate to protect the electrical elements while providing pit structure for the heater and for ink flow bypass. A tantalum film is formed on the surface of the polyimide layer to protect the layer from the effects of corrosive ink. In another embodiment, the ink resistant film is amorphous carbon or silicon nitride.

10 Claims, 1 Drawing Sheet

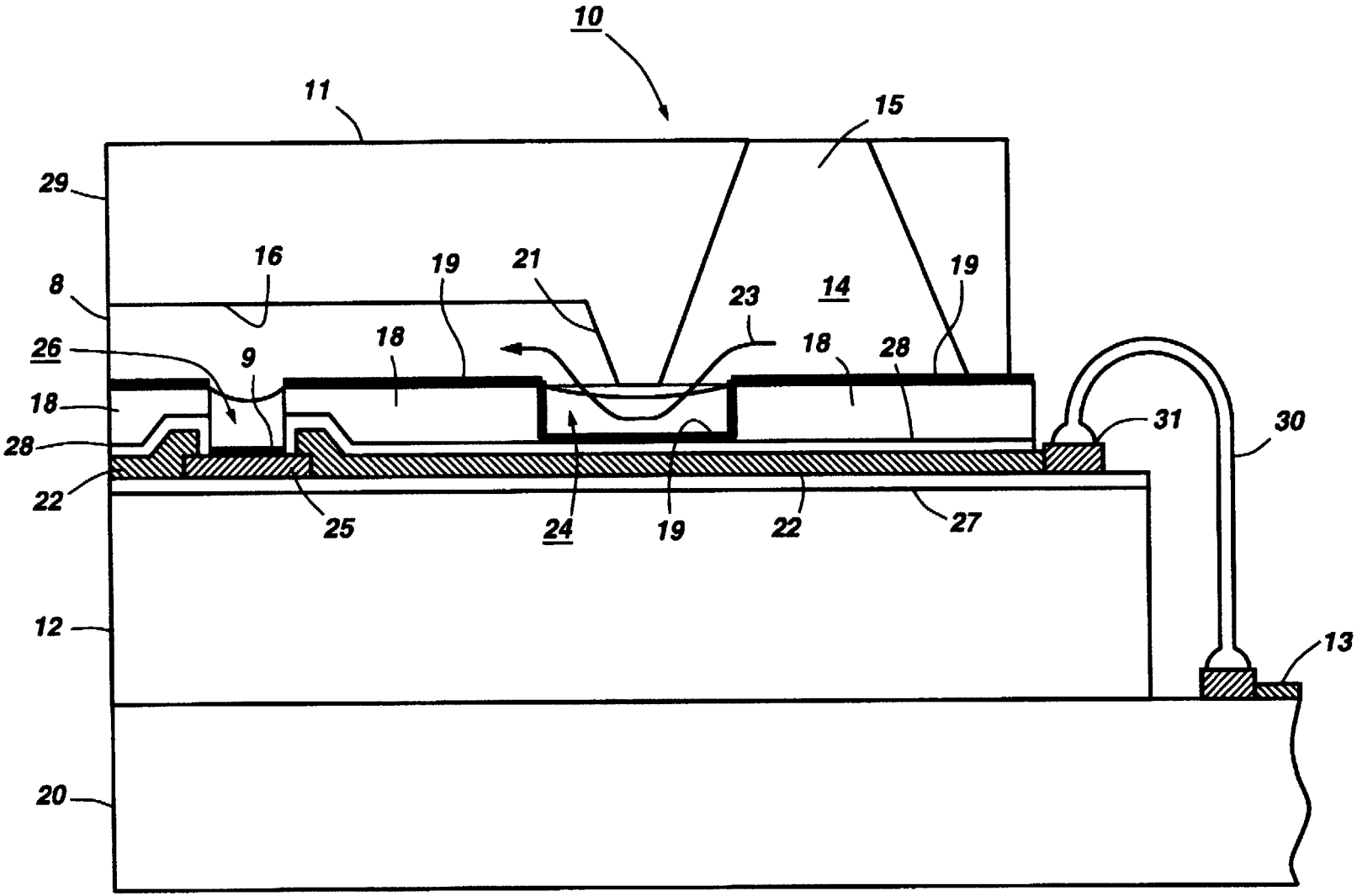
10
11
12
13
14
15
16
18
19
20
21
22
23
24
25
26
27
28
29
30
31
8
9

THERMAL INK JET PRINTHEAD WITH IMPROVED INK RESISTANCE

BACKGROUND OF THE INVENTION AND MATERIAL DISCLOSURE STATEMENT

This invention relates to an ink jet printing device which uses energy to cause ink droplets contained within channels formed internally to the printhead to be expelled from an orifice onto a recording material. More particularly, the invention relates to an ink jet printhead having improved protection from the corrosive effects of ink on ink sensitive areas of the printhead.

In the ink jet printing art, a printhead is provided having one or more ink filled channels communicating with an ink supply chamber, the channels having one end formed as a nozzle orifice. The ink forms a meniscus at the nozzle prior to being expelled. Energy is applied to the ink channels in the form of heat created by pulsing heating resistors or by a piezoelectrically applied force to the channel walls to cause an ink droplet to be expelled from the nozzle onto the recording material. After a droplet is expelled, additional ink replenishes the channel and reforms the meniscus.

The ink must flow in such a manner that the energy generator, either the resistor heater element in a thermal ink jet primer or piezoelectric plates in the piezo printer are in sufficient contact to transfer energy to the ink. Because of the corrosive nature of the ink used, the electronic circuitry associated with the energy generators must be protected by a protective coating which must also be photo-imageable to pattern and expose the energy generating elements during the fabrication process. Preferred photo-imageable materials used extensively in the prior art for passivation and other purposes are polymers such as polyimide and dry film solder mask polymers (PMMA). For example, as disclosed in U.S. Pat. Nos. 4,774,530 and 4,829,324, the top surface of a heater wafer is patterned with a relatively thick pattern layer of polyimide which is applied in a curing process and passivates the underlying electronic circuitry while also placing the heater surface at the bottom of a pit structure to improve ink ejection characteristics. Polymers have also been used to form a nozzle plate for a printhead as disclosed in U.S. Pat. No. 5,291,226.

The use of polymers in ink jet printheads has certain disadvantages. One is the poor resistance to colored and waterfast inks having strong bases and polar solvents, resulting in corrosion of the polyimide coating. Another disadvantage is sensitivity to high temperatures.

SUMMARY OF THE INVENTION

It is an object of the present invention to provide an ink jet printing device wherein an ink resistant film is deposited on the polymer layer to protect the layer from the corrosive effects of the ink.

In one embodiment, the ink resistant film is tantalum sputtered over a cured polyimide layer with the tantalum etched away from the electrode bonding terminals.

In another embodiment, a plasma CVD (chemical vapor deposition) film such as amorphous carbon or silicon nitride is deposited on a polyimide layer at temperatures significantly lower than the polyimide cure temperature.

More particularly, the present invention relates to a printhead for ejecting a recording liquid onto a recording medium, the printhead having an internal structure which includes at least a channel for holding said recording liquid, at least one nozzle for ejecting liquid onto the recording medium, channel means providing a liquid flow path between said chamber and said nozzle, an energy generator for introducing energy into the liquid contained in said channel, means for selectively energizing said energy generating means so as to cause periodic ejections of said liquid through said nozzle onto said recording medium and a cured photo-imageable polymer formed in at least a portion of said internal structure and an ink resistant film formed on at least a portion of the surface of said polymer.

BRIEF DESCRIPTION OF THE DRAWINGS

FIG. 1 is an enlarged cross-sectional view of a thermal ink jet print element showing a heater plate having a patterned polymer layer passivating electronic control elements, with an ink resistant film patterned over the polymer layer surface.

DESCRIPTION OF THE INVENTION

The invention will be described in conjunction with a thermal ink jet print element of the type disclosed in U.S. Re. 32,572 to Hawkins et al., U.S. Pat. No. 5,010,355 to Hawkins et al. and U.S. Pat. No. 4,851,371 to Fisher et al., the disclosures of all of which are hereby incorporated by reference. It is understood that the invention has utility for other types of printhead structures as will be seen. As disclosed in these patents, thermal ink jet printheads are generated in batches by aligning and adhesively bonding an anisotropically etched channel wafer to a heater wafer followed by a dicing step to separate the bonded wafer into individual printheads. The prior art interposed a patterned thick film insulative layer, typically a polymer material, between the channel wafer and the heater wafer. A preferred insulation material has been polyimide. According to the invention, and as shown in FIG. 1, layer 18 is formed of a photo-imageable polyimide and an ink resistant film 19 is formed on the surface of layer 18 to protect the polyimide from the corrosive effects of ink. FIG. 1 shows a cross-sectional view of a printhead. Printhead 10 comprises an anisotropically etched channel plate 11 aligned and bonded to heater plate 12. The printhead is fixedly attached to a daughter board 20 having electrodes 13 thereon which connect to a drive circuit and power supply (not shown). The channel plate 11 has a through etched reservoir 14 with its open end serving as inlet 15 and a plurality of channels 16 anisotropically etched therein. Ends of the channels 16 open through nozzle face 29 and terminates at slanted ends 21. The open ends of the channels serve as nozzles 8. The heater plate has an array of heating elements 25 and addressing electrodes 22 formed on the surface of the heater plate 12 which confront the channel plate. The heating elements and electrodes are formed on an insulative layer 27 and are passivated by an insulative layer 28. A protective layer 9, such as tantalum, is deposited over the heating elements. Thick film insulative layer 18, in a preferred embodiment, is a 10 micron thick photosensitive polyimide interposed between the heater plate and the channel plate. Layer 18 is patterned and cured to expose the heating elements, thereby placing them in separate pits 26 and to form ink flow bypass pits 24 between the reservoir 14 and the ink channel 16. Layer 18 is also patterned to expose the electrode bonding terminals 31. Following the patterning step, layer 18 is cured. Ink thus flows from reservoir 14 to channels 16 around the closed end of the channels 21 as shown by arrow 23. The terminals 31 are connected to the daughter board electrodes 13 by wire bonds 30. The anisotropically etched channels 16 have a triangular cross-sectional area and the materials surrounding the nozzle at the nozzle face 29 is silicon on two sides of the triangular shaped nozzle and thick film material layer on the third side.

As is evident, the ink flows over patterned areas of layer 18 which, if unprotected, would be subject to the corrosive effects of the ink. However, and according to the invention, layer 18 is protected by an ink resistant film 19 which, in a first embodiment, is tantalum. Film 19 is formed following the patterning and curing of the polyimide layer by a low temperature process such as sputtering. Conformal coverage of film 19 serves to seal interfaces and enhance ink protection.

The tantalum film overlies the patterned areas of layer 18 and the protective layer 9 which was deposited over heating elements 25. Film 19 is electrically isolated by removing the film from bonding terminal 31 by standard lithographic techniques and by plasma etching which does not attack the aluminum bonding terminals.

In this first embodiment of the invention, an ink resistant film of tantalum is formed for the main purpose of protecting otherwise exposed surfaces of the polyimide layer 18 to the corrosive effects of the ink flow therepast. An additional advantage of the use of tantalum as the ink resistant film is the opportunity to delete a printhead manufacturing process step which would deposit the protective layer 9 over the heating element 25. This step can be eliminated since the film 19 can be used to accomplish the same function by leaving the tantalum layer overlying the heating elements.

In a second embodiment of the invention, ink resistant film 19 is a plasma CVD film, amorphous carbon in the preferred embodiment. The amorphous carbon film is deposited after the polyimide layer 18 is patterned and cured, at temperatures significantly lower than the polyimide cure temperature; for example, the polyimide is cured at temperatures of approximately 350°–400° C. while the carbon film is deposited at temperatures of 250° C. or lower. The plasma CVD film is then removed from the bonding terminals 31 by lithographic and plasma etching techniques. The plasma CVD method offers the ability to produce dense films with excellent step coverage, chemical resistance and mechanical properties even at low substrate temperature (<250° C.). This is particularly true for carbon-based films which may approach a structure similar to that of diamond with related properties, hence the name diamond-like carbon (DLC). The electrical and thermal conductivity of these films can also be systematically controlled through judicious choice of the deposition conditions. These properties may affect device performance and allow for the elimination of the protective layer 9. In a third embodiment of the invention, a plasma CVD silicon nitride (SiNx) film 19 is deposited at room temperature. The properties of this film allow for direct wire bonding through the film to the electrical connections on the print element. This eliminates the need for patterning the film off the bonding pad regions of the device.

The advantage of the ink resistant film is not limited only to the structure disclosed above but is equally useful in any of the printheads discussed supra. For example, the nozzle member disclosed in U.S. Pat. No. 5,291,226 is described as formed of a polymer material section. The ink resistant film of the present invention can be formed to protect this section. As another example, and as disclosed in U.S. Pat. No. 5,008,689, a printhead includes an orifice plate and an ink channel, the ink in the channel heated by a resistor. The resistor is formed on a plastic layer. The ink resistant film embodied in the present invention can be used to cover and protect the plastic layer. The contents of the '226 patent are hereby incorporated by reference.

While the embodiment disclosed herein is preferred, it will be appreciated from this teaching that various alternative, modifications, variations or improvements therein may be made by those skilled in the art, which are intended to be encompassed by the following claims:

We claim:

1. A printhead for ejecting a recording liquid onto a recording medium, the printhead having an internal structure which includes at least a channel for holding said recording liquid, at least one nozzle for ejecting liquid onto the recording medium, channel means providing a liquid flow path between said chamber and said nozzle, an energy generator for introducing energy into the liquid contained in said channel, means for selectively energizing said energy generating means so as to cause periodic ejections of said liquid through said nozzle onto said recording medium and a cured polymer formed in at least a portion of said internal structure and an ink resistant tantalum film formed on at least a portion of said polymer.

2. The printhead of claim 1 wherein the printhead includes an upper substrate comprising a channel plate etched to form a set of parallel groves, the grooves serving as said channel means and a lower substrate comprises a heater plate, said energy generating means comprising an array of heater elements formed on said lower substrate surface, said means for selectively energizing said energy generating means including electrode bonding terminals formed on said lower substrate surface, the upper and lower substrates, when aligned and bonded together forming said printhead and wherein said polymer is deposited on the heater substrate over the heating and bonding terminals and patterned to define therein heater and recess pits.

3. The printhead of claim 2 wherein said ink resistant film is a metal and wherein said film is also formed as a film over said array of heater elements to form a protective layer over said elements.

4. The printhead of claim 3 wherein said polymer is polyimide and said ink resistant film is tantalum.

5. The printhead of claim 4 wherein said tantalum film is removed from said terminals by lithographic techniques and plasma etching.

6. The printhead of claim 1 wherein a plurality of nozzles are used to selectively eject the recording liquid, said nozzles being formed in a plate comprising said polymer.

7. An improved ink jet printhead of the type having a silicon upper substrate in which one surface thereof is anisotropically etched to form both a set of parallel grooves for subsequent use as ink channels and an anisotropically etched recess for subsequent use as a manifold, and further having a lower substrate in which one surface thereof has an array of heating elements and addressing electrodes formed thereon, the upper and lower substrates being aligned, mated, and bonded together to form the printhead with a thick film insulative layer sandwiched therebetween, the thick film insulative layer having been deposited on the surface of the lower substrate and over the heating elements and addressing electrodes and patterned to form recesses therethrough to expose the heating elements and terminal ends of the addressing electrodes prior to said mating and bonding of the substrates, wherein the improvement comprises:

forming an ink resistant tantalum film on said insulative layer.

8. An ink jet printhead comprising a plurality of channels, wherein the channels are capable of being filled with ink from an ink supply and wherein the channels terminate in nozzles on one surface of the printhead, the nozzles being formed in a layer comprising a photo-imageable polymer having a surface covered by an ink resistant tantalum film.

9. An ink jet printhead comprising a plurality of channels, wherein the channels are capable of being filled with ink from an ink supply, the ink in the channels being heated by a resistor formed on a plastic layer, and wherein the channels terminate in nozzles on one surface of the printhead, the plastic layer comprising a photo-imageable polymer having an ink resistant tantalum film on a surface.

10. A thermal ink jet printhead which includes an orifice plate having an ink channel therein and an ink reservoir for supplying ink to said orifice through said channel, a heater for heating the ink in said channel upon application of a current therethrough and a substrate for supporting said heater, the substrate comprising a cured photo-imageable polymer having an ink resistant tantalum film on one surface.

* * * * *